US008690150B2

(12) United States Patent
Obara et al.

(10) Patent No.: US 8,690,150 B2
(45) Date of Patent: Apr. 8, 2014

(54) SHEET FEED DEVICE AND IMAGE FORMING APPARATUS WITH ROTATION STACKING PORTION

(71) Applicant: Canon Kabushiki Kaisha, Tokyo (JP)

(72) Inventors: Yuichi Obara, Zama (JP); Akira Omori, Suntou-gun (JP); Ichiro Yasumaru, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/756,674

(22) Filed: Feb. 1, 2013

(65) Prior Publication Data

US 2013/0207336 A1 Aug. 15, 2013

(30) Foreign Application Priority Data

Feb. 9, 2012 (JP) ..... 2012-026411

(51) Int. Cl.
*B65H 1/08* (2006.01)

(52) U.S. Cl.
USPC ..... 271/127; 271/117; 271/121

(58) Field of Classification Search
USPC ..... 271/117, 121, 127
See application file for complete search history.

(56) References Cited

U.S. PATENT DOCUMENTS

| | | | | |
|---|---|---|---|---|
| 5,951,002 | A * | 9/1999 | Yokota | 271/117 |
| 7,036,813 | B2 * | 5/2006 | Asada | 271/117 |
| 7,699,307 | B2 * | 4/2010 | Sasaki | 271/127 |
| 7,806,397 | B2 * | 10/2010 | Wang et al. | 271/9.13 |
| 7,938,396 | B2 * | 5/2011 | Okumura et al. | 271/127 |

FOREIGN PATENT DOCUMENTS

JP 11-49388 A 2/1999

* cited by examiner

*Primary Examiner* — Gerald McClain
(74) *Attorney, Agent, or Firm* — Fitzpatrick, Cella, Harper & Scinto

(57) ABSTRACT

A sheet feed device includes a sheet stacking portion that has a rotation stacking portion which is rotatable, a sheet feed roller that feeds the sheet stacked in the sheet stacking portion, and a separating portion that separates the sheet fed by the sheet feed roller. The rotation stacking portion is configured to be rotatable about a rotation fulcrum on a downstream side in a sheet feed direction.

9 Claims, 7 Drawing Sheets

SHEET FEED DEVICE AND IMAGE FORMING APPARATUS WITH ROTATION STACKING PORTION

BACKGROUND OF THE INVENTION

1. Field of the Invention

The present invention relates to a sheet feed device and an image forming apparatus, and more particularly, to a sheet feed device capable of separating and feeding sheets one by one and an image forming apparatus including the sheet feed device.

2. Description of the Related Art

Image forming apparatuses, such as copying machines, printers, facsimiles, or multi-functional apparatuses, have been conventionally known which each include a sheet feed device that separates and feeds sheets stacked in a sheet cassette, a sheet tray, or the like to an image forming portion one by one.

Such a sheet feed device includes a separating portion that separates sheets one by one. There are the following various type of separating portions. For example, an air separation type separating portion is known which loosens a stacked sheet by blowing air the stacked sheet, and then sucks and conveys the sheets one by one. A friction separation type separating portion is also known which separates and conveys the sheet using a friction force between a sheet feed roller and a friction member and a friction force between the sheets. Further, an inclination surface separation type separating portion is known which brings the front end of a sheet into contact with an inclination surface and separates the sheet.

In recent years, a miniature image forming apparatus has been placed and used on a desk in many offices and homes, and thus it is preferable to realize miniaturization and low cost of the image forming apparatus. Therefore, since a sheet feed device installed in an image forming apparatus is also necessarily miniaturized and manufactured at low cost, the above-described inclination surface separation type is suitable for the miniaturization and reducing cost. In general, an inclination surface separation type sheet feed device includes a sheet feed roller attached to a roller arm installed to be vertically rotatable and is configured such that the sheet feed roller is brought into contact with a topmost sheet and sends the sheet, and then slides the sheet to a separation wall to separate the sheet (see Japanese Patent Laid-Open No. 11-49388).

As illustrated in FIGS. 7A and 7B, an inclination surface separation type sheet feed device 100 is installed such that a roller arm 163 holding a sheet feed roller 162 is vertically rotatable about a rotation shaft 160. A topmost sheet S1 is fed by causing the sheet feed roller 162 to press the surface of the topmost sheet S1 among sheets S stacked in a fixed stacking portion 124. The topmost sheet S1 fed by the sheet feed roller 162 is slid to a separation wall 125, is separated by the friction of the separation wall 125, and is sent.

In the inclination surface separation type sheet feed device, when the number of stacked sheets S is large, an angle $\alpha$ formed between a line, which binds a rotation fulcrum of the roller arm 163 and a contact position of the sheet feed roller 162 with the topmost sheet S1, and a stacking surface of the fixed stacking portion 124 is small (see FIG. 7A). Conversely, the angle $\alpha$ increases, as the number of stacked sheets S is smaller (see FIG. 7B). On the assumption that F is a rotation force of the sheet feed roller 162, the abutting pressure (feeding pressure) of $F\sin\alpha$ for the topmost sheet S1 is applied from the sheet feed roller 162. Accordingly, an abutting pressure (feeding pressure) of the sheet feed roller 162 to the topmost sheet S1 is increased, as the angle $\alpha$ increases. In contrast, the abutting pressure (feeding pressure) is decreased, as the angle $\alpha$ decreases. Therefore, when the number of stacked sheets S is large, there is a concern that no sheet may be fed (feed failure) since the abutting pressure is low. Further, when the number of stacked sheet S is small, there is a concern that two or more sheets may be fed (double conveyance) since the abutting pressure is high.

A difference in the thickness of a sheet, for example, a difference in a basis weight has a large influence on whether the feed failure or the double conveyance occurs. When a thin sheet with a small basis weight is fed, a necessary abutting pressure is small. However, when a thick sheet with a large basis weight is fed, a necessary abutting pressure is large. In recent years, in order to reduce an environmental load, a thin sheet (for example, a sheet with a basis weight in the range of about 50 to about 60 ($g/m^2$)) with a low basis weight is used in many cases. When a thin sheet is fed, a necessary abutting pressure is low. Therefore, when the number of stacked sheets is small, there is the concern that the double conveyance may occur.

It is desirable to provide a sheet feed device in which a sheet separation capability is improved.

SUMMARY OF THE INVENTION

According to an aspect of the invention, a sheet feed device which feeds a sheet includes a sheet stacking portion that includes a rotation stacking portion which is rotatable; a sheet feed roller that feeds the sheet stacked in the sheet stacking portion; and a separating portion that separates the sheet fed by the sheet feed roller. The rotation stacking portion is configured to be rotatable about a rotation fulcrum on a downstream side in a sheet feed direction.

According to the aspect of the invention, the rotation stacking portion is configured to be rotatable about the rotation fulcrum on the downstream side in the sheet feed direction. Accordingly, the separation capability of the sheet feed device can be improved.

Further features of the present invention will become apparent from the following description of exemplary embodiments with reference to the attached drawings.

DESCRIPTION OF THE EMBODIMENTS

Figure 1:
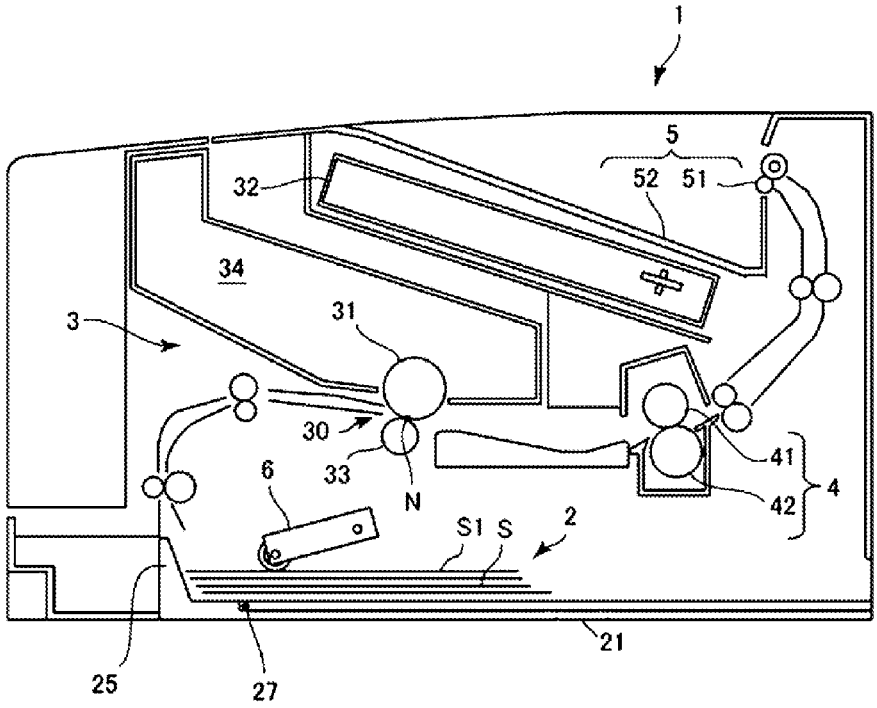
FIG. 1 is a sectional view schematically illustrating an overall configuration of an image forming apparatus according to an embodiment of the invention.

Hereinafter, an image forming apparatus including a sheet feed device according to an embodiment of the invention will be described with reference to FIGS. 1 to 6D. The image forming apparatus according to this embodiment is an image forming apparatus 1, such as a copying machine, a printer, a facsimile, or a multi-functional apparatus, which includes a sheet feed device capable of separating and feeding sheets one by one. First, the general configuration of the image forming apparatus 1 according to this embodiment will be described with reference to FIG. 1. FIG. 1 is a sectional view schematically illustrating the overall configuration of the image forming apparatus 1 according to the embodiment of the invention.

As illustrated in FIG. 1, the image forming apparatus 1 includes a sheet feed device 2 that feeds a sheet, an image forming portion 3 that forms an image on the sheet, and a sheet discharge portion 5 that discharges the sheet on which the image is fixed. The image forming portion 3 includes a transfer portion 30 that transfers an image to a sheet and a fixing portion 4 that fixes the image transferred from the transfer portion on the sheet. The sheet feed device 2 is installed in the lower part of the image forming apparatus 1 and feeds a topmost sheet S1 to the image forming portion 3 while separating the topmost sheet S1 from the sheets S one by one. The sheet feed device 2 will be described in detail below.

The transfer portion 30 includes a photosensitive drum 31 that is installed above the sheet feed device 2 and forms a toner image, a charger (not illustrated) that uniformly charges the surface of the photosensitive drum 31, and an exposure portion 32 that forms an electrostatic latent image on the photosensitive drum 31 by performing irradiation with laser light. The transfer portion 30 further includes a development portion (not illustrated) that visualizes the electrostatic latent image formed on the photosensitive drum 31 as a toner image and a transfer roller 33 that forms a transfer nip N together with the photosensitive drum 31. The photosensitive drum 31, the charger, and the development portion are formed as one cartridge unit, and thus are configured as a process cartridge 34 to be detachably mounted on the apparatus body.

The fixing portion 4 is installed on the downstream side of the image forming portion 3 in a sheet conveyance direction and includes a fixing roller 41 that includes a heater therein and a pressure roller 42 that is pressed to the fixing roller 41. The sheet discharge portion 5 is installed on the downstream side of the fixing portion 4 in the sheet conveyance direction and includes a pair of discharge rollers 51 that discharge a sheet from the inside of the apparatus body and a discharge tray 52 in which the discharged sheet is stacked.

Next, an image forming job performed by the image forming apparatus 1 having the above-described configuration will be described. When the image forming job starts, the exposure portion 32 irradiates the surface of the photosensitive drum 31 with laser light according to an image information signal transmitted from a PC or a scanner (not illustrated). Thus, the surface of the photosensitive drum 31 uniformly charged with a predetermined polarity potential by the charger is exposed, and thus an electrostatic latent image is formed on the surface of the photosensitive drum 31. When the electrostatic latent image is formed on the surface of the photosensitive drum 31, the development portion develops the electrostatic latent image so that the electrostatic latent image is visualized as a toner image.

In parallel with the above-described process of forming the toner image, the topmost sheet S1 is separated from the sheets S and is fed one by one by the sheet feed device 2. Then, the sheet fed by the sheet feed device 2 is conveyed to the transfer nip N between the photosensitive drum 31 and the transfer roller 33 at a predetermined timing by a pair of intermediate conveyance rollers disposed on the downstream side of the sheet feed device 2 in the sheet conveyance direction. The above-described visualized toner image is transferred to the sheet conveyed to the transfer nip N by the transfer roller 33, and the toner image is formed.

The sheet to which the toner image is transferred is conveyed from the transfer nip N to the fixing portion 4, and the toner is subjected to melting and color mixing to be fixed as an image, when the fixing roller 41 and the pressure roller 42 apply heat and pressure. Thereafter, the sheet on which the image is fixed is discharged to the discharge tray 52 by the pair of discharge rollers 51, and thus the image forming job ends.

Figure 2A:
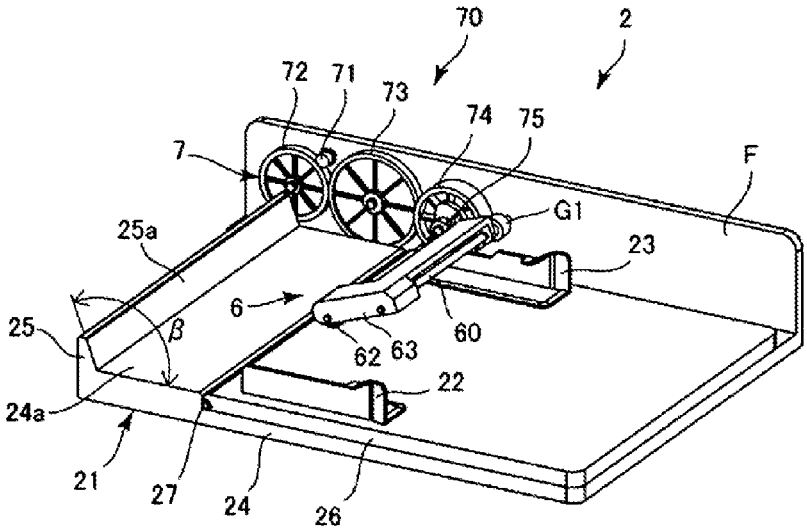
FIG. 2A is a perspective view illustrating a sheet feed device of the image forming apparatus according to the embodiment.
Figure 2B:
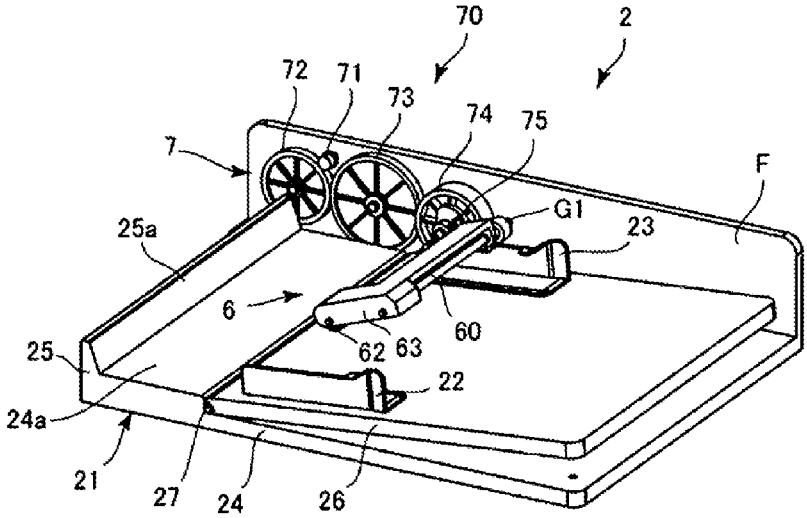
FIG. 2B is a perspective view illustrating a state in which a rotation stacking portion of the sheet feed device is rotated.
Figure 3:
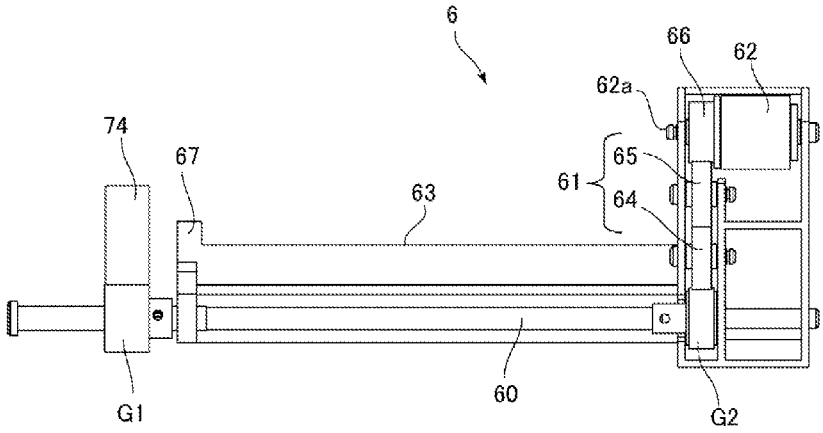
FIG. 3 is a sectional view illustrating a sheet feed portion that feeds a sheet.
Figure 4A:
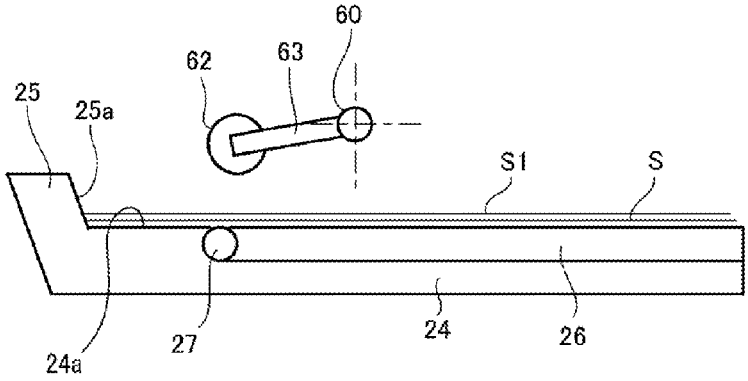
FIG. 4A is a sectional view schematically illustrating a lifting state of a sheet feed roller.
Figure 4B:
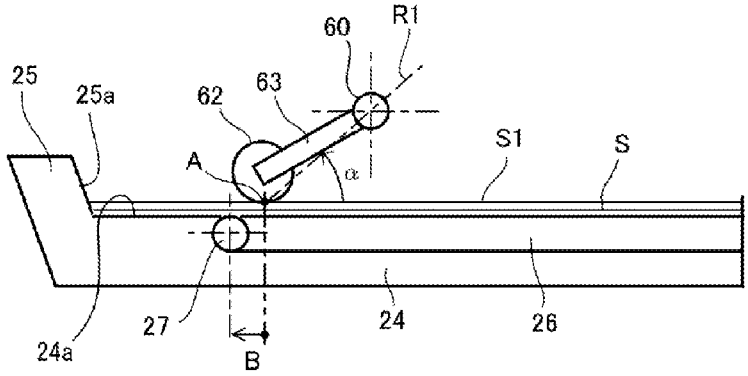
FIG. 4B is a sectional view schematically illustrating a state in which the sheet feed roller is lowered and comes into contact with the topmost sheet.
Figure 5A:
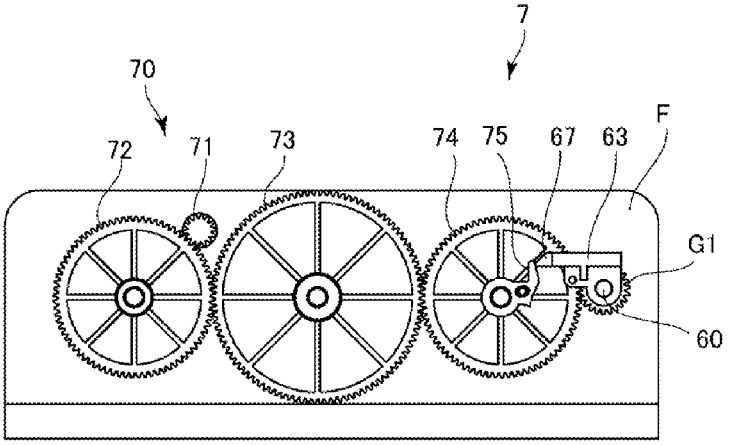
FIG. 5A is a front view illustrating a driving transmission mechanism that transmits driving to the sheet feed portion.
Figure 5B:
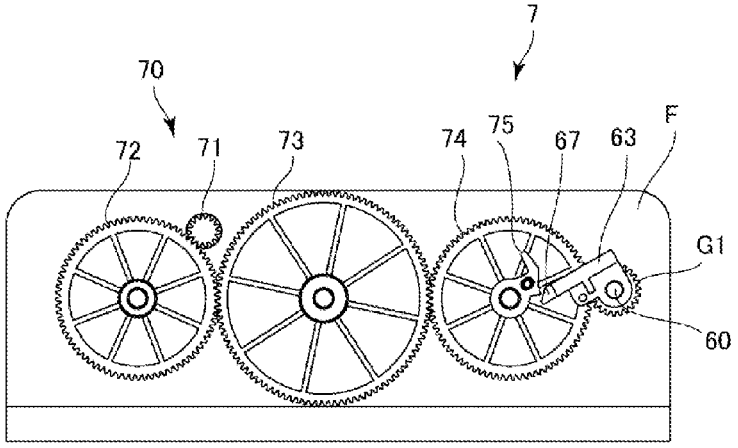
FIG. 5B is a front view illustrating the driving transmission mechanism when the sheet feed roller is lowered.

Next, the sheet feed device 2 according to this embodiment will be described with reference to FIGS. 2A to 6D. First, the configuration of the sheet feed device 2 will be described with reference to FIGS. 2A to 5B. FIG. 2A is a perspective view illustrating the sheet feed device 2 of the image forming apparatus 1 according to this embodiment. FIG. 2B is a perspective view illustrating a state in which the rotation stacking portion 26 of the sheet feed device 2 is rotated. FIG. 3 is a sectional view illustrating the sheet feed portion 6 that feeds a sheet. FIG. 4A is a sectional view schematically illustrating a state in which the sheet feed roller 62 is lifted. FIG. 4B is a sectional view schematically illustrating a state in which the sheet feed roller 62 is lowered and comes into contact with the topmost sheet S1. FIG. 5A is a front view illustrating a driving transmission mechanism 70 that transmits driving to a sheet feed portion 6. FIG. 5B is a front view illustrating the driving transmission mechanism 70 when the sheet feed roller 62 is lowered.

As illustrated in FIG. 2, the sheet feed device 2 includes a sheet stacking portion 21 in which the sheet S is stacked and the sheet feed portion 6 that feeds the topmost sheet S1 one by one from the sheets S stacked in the sheet stacking portion 21. The sheet feed device 2 further includes a separation wall 25 serving as a separating portion that separates a sheet to be fed to the sheet feed portion 6 and a feed driving portion 7 that drives the sheet feed portion 6.

The sheet stacking portion 21 in which the sheet S is stacked is disposed below the sheet feed portion 6. The sheet stacking portion 21 includes a fixed stacking portion 24 that is able to stack the sheet S and a rotation stacking portion 26 that is held by the fixed stacking portion 24 to be rotatable. The sheet S stacked in the sheet stacking portion 21 is regulated such that the position in a sheet width direction perpendicular to the sheet feed direction is regulated by width direction regulation plates 22 and 23.

The separation wall 25 is erected in the end on the downstream side (hereinafter, simply referred to as a "downstream side") of the fixed stacking portion 24 in the sheet feed direction and includes a separation inclination surface 25*a* inclined upwardly (for example, by up "$\beta=110°$") in the sheet feed direction with respect to the sheet stacking surface 24*a* of the fixed stacking portion 24. The separation wall 25 comes into contact with the front end of the sheet S along the separation inclination surface 25*a* to dam the sheet located below the topmost sheet S1 and loosens only the topmost sheet S1 from the sheets S by cooperation with a sheet feeding process performed by the sheet feed roller 62 to be described below.

The rotation stacking portion 26 is held such that the end on the downstream side is rotatable about a rotation shaft 27, which serves as a rotation fulcrum parallel to the sheet width direction, with respect to the fixed stacking portion 24, and thus is configured to be lifted and lowered on the upstream side (hereinafter, simply referred to as an "upstream side") in the sheet feed direction. That is, the rotation stacking portion 26 is configured to be rotated between a position at which the rotation stacking portion 26 is substantially parallel and substantially horizontal to the fixed stacking portion 24 and a position at which the rotation stacking portion 26 is rotated so that the upstream side of the sheet S stacked in the fixed stacking portion 24 is the upside.

When a thin sheet is fed, the necessary abutting pressure is low. Therefore, when the number of stacked sheets is small, the feeding pressure (abutting pressure) of the sheet feed roller 62 to the topmost sheet is increased. Thus, there is a concern that the double conveyance may occur. The reason will be described. When a feeding pressure (abutting pressure) to the topmost sheet is increased, the friction force to the second sheet is also increased, and thus a force moving the second sheet in the conveyance direction is increased. Then, the friction force to the second sheet exceeds a necessary feeding pressure (abutting pressure), the double conveyance consequently occurs. Accordingly, in this embodiment, a thin sheet is prevented from being doubly conveyed by rotating the rotation stacking portion 26 upward and decreasing the feeding pressure (abutting pressure) of the sheet feed roller 62 to the sheet. In this embodiment, an operation of rotating the rotation stacking portion 26 can be performed by a user.

The sheet feed device 2 includes an inclination stay 28 serving as a hold member that holds the rotation stacking portion 26 rotated so that the angle $\alpha$ is smaller than a predetermined angle when the rotation stacking portion 26 lifts the upstream side of the sheet S (see FIGS. 6A to 6D to be described below). The inclination stay 28 is used to hold the rotation stacking portion 26 at a rotation position at which the rotation stacking portion 26 is rotated so that the angle $\alpha$ is smaller than the predetermined angle, when the basis weight of a sheet stacked in the sheet stacking portion 21 is smaller than a predetermined basis weight or the rigidity of the sheet is smaller than a predetermined rigidity.

The angle $\alpha$ refers to an angle formed between the stacking surface (or the surface of the topmost sheet S1) of the rotation stacking portion 26 and a line R1 binding a rotation fulcrum of a pivot shaft 60 holding a roller arm 63, which is described below, to be rotatable and a contact point A between the sheet feed roller 62 and the topmost sheet S1.

In this embodiment, the angle $\alpha$ at the position at which the rotation stacking portion is rotated upward is smaller than the angle $\alpha$ at the position at which the rotation stacking portion is substantially horizontal.

The predetermined angle refers to, for example, an angle or the like when the small number of sheets (for example, thin sheets) with a basis weight smaller than the predetermined basis weight or with a rigidity smaller than the predetermined rigidity is stacked in the rotation stacking portion 26 in a substantially horizontal state (hereinafter, referred to as a "flat state") in which the rotation stacking portion 26 is not rotated (a state where the number of stacked sheets is small or is reduced).

The width direction regulation plates 22 and 23 are held to be slidable in the sheet width direction and regulate both ends of the sheet S stacked in the sheet stacking portion 21 in the sheet width direction, so that sheet feed stability in the sheet stacking portion 21 can be improved when the sheet is fed.

In this embodiment, the width direction regulation plates 22 and 23 are installed in the rotation stacking portion 26, but the invention is not limited thereto. For example, the width direction regulation plates 22 and 23 may be installed in a base portion 24 below the fixed stacking portion 24. In this case, it is necessary to configure the width direction regulation plates 22 and 23 so as not to interfere with the rotation stacking portion 26, but the thickness of the rotation stacking portion 26 can be thinned. This is because the rotation stacking portion 26 may be configured to have rigidity to the extent that the rotation stacking portion 26 can sustain the weight of a sheet, since the width direction regulation plates 22 and 23 may not be formed in the rotation stacking portion 26.

As illustrated in FIG. 3, the sheet feed portion 6 includes the pivot shaft 60 connected to the feed driving portion 7, a gear line 61 connected to the pivot shaft 60, the sheet feed roller 62 connected to the gear line 61, and the roller arm 63 serving as a roller holding portion that holds the sheet feed roller 62 or the like to be rotatable.

The pivot shaft 60 is installed to be parallel to the sheet width direction and is configured such that one end is held by a frame F (see FIGS. 2A and 2B) of the apparatus body to be rotatable. Further, a first driving gear G1 connected to the driving transmission mechanism 70, which is described below, in the feed driving portion 7 is adhered to the vicinity of the one end of the pivot shaft 60 and a second driving gear G2 is adhered to the vicinity of the other end of the pivot shaft 60. The gear line 61 is held by the roller arm 63 to be rotatable and includes a first gear 64 engaging with the second driving gear G2 and a second gear 65 engaging with the first gear 64. The number of gears of the gear line may be appropriately changed according to the distance between the pivot shaft 60 and the sheet feed roller 62.

In the sheet feed roller 62, a roller gear 66 is adhered to a rotation shaft 62*a* held by the roller arm 63 to be rotatable. The roller gear 66 engages with the second gear 65 of the gear line 61. The roller arm 63 is configured such that the base end as the other end side is held by the pivot shaft 60 to be rotatable and the sheet feed roller 62 is held by the front end as one end side to be rotatable. The roller arm 63 is configured such that the sheet feed roller 62 comes into contact with the topmost sheet S1 when the sheet feed roller 62 falls due to the own weight or the like of the sheet feed roller 62. The roller arm 63 includes an engagement protrusion portion 67 that can engage with a lifting and lowering cam 75, which is described below, in the driving transmission mechanism 70 and is configured to be vertically pivoted (rotated) since the engagement protrusion portion 67 engages with the rotated lifting and lower cam 75.

Here, as illustrated in FIGS. 4A and 4B, the rotation stacking portion 26 is held by the fixed stacking portion 24 so that the rotation shaft 27 is located on the downstream side of the contact point A between the sheet feed roller 62 and the topmost sheet S1 when the roller arm 63 is rotated and the sheet feed roller 62 comes into contact with the surface of the topmost sheet S1. In other words, the sheet feed roller 62 (the pivot shaft 60) is disposed so that the contact point between the sheet stacking surface of the rotation stacking portion 26 and the sheet feed roller 62 at the time of rotating the roller arm 63 and bringing the sheet feed roller 62 into contact with the topmost sheet S1 is located on the upstream side of the rotation shaft 27 of the rotation stacking portion 26. In other words, the sheet feed roller 62 (the pivot shaft 60) is disposed so that the contact point A between the topmost sheet S1 and the sheet feed roller 62 at the time of rotating the roller arm 63 and bringing the sheet feed roller 62 into contact with the topmost sheet S1 is located on the upstream side of the rotation shaft 27 of the rotation stacking portion 26. In this embodiment, the rotation shaft 27 is installed on the downstream side by a distance corresponding to an arrow B illustrated in FIG. 4B.

As illustrated in FIGS. 5A and 5B, the feed driving portion 7 includes a driving motor (not illustrated) and the driving transmission mechanism 70 that transmits the driving of the driving motor to the sheet feed portion 6. The driving transmission mechanism 70 includes a driving input gear 71 connected to the driving motor, a first intermediate gear 72 engaging with the driving input gear 71, a second intermediate gear 73 engaging with the first intermediate gear 72, a roller arm driving gear 74 engaging with the second intermediate gear 73, and the lifting and lowering cam 75. The driving input gear 71, the first intermediate gear 72, the second intermediate gear 73, and the roller arm driving gear 74 are held by the frame F of the apparatus body. The lifting and lowering cam 75 is adhered to the roller arm driving gear 74 coaxially to interlock with the rotation of the roller arm driving gear 74. Further, the driving input gear 71 may be connected directly to the driving motor coaxially or via, for example, a gear line for constant velocity or deceleration. The roller arm driving gear 74 engages with the first driving gear G1, and thus transmits the driving force of the driving motor to the sheet feed portion 6.

Figure 6A:
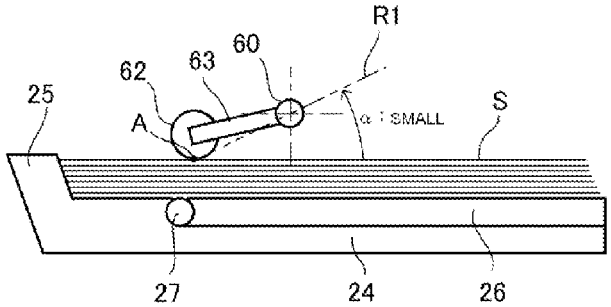
FIG. 6A is a sectional view illustrating the rotation stacking portion in a flat state, when sheets are fully stacked.
Figure 6B:
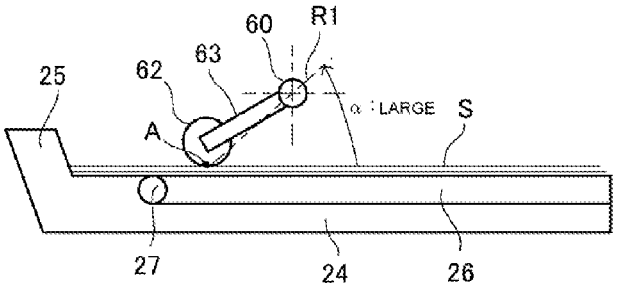
FIG. 6B is a sectional view illustrating the rotation stacking portion in a flat state, when a few of sheets are stacked.
Figure 6C:
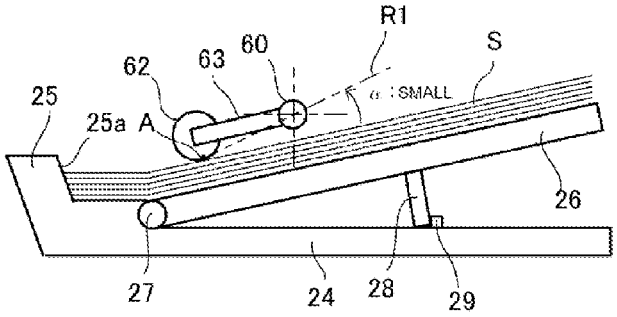
FIG. 6C is a sectional view illustrating the rotation stacking portion in a rotation state, when the sheet are fully stacked.
Figure 6D:
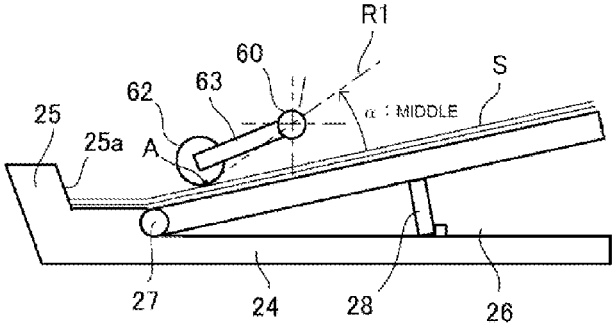
FIG. 6D is a sectional view illustrating the rotation stacking portion in a rotation state, when a few of sheets are stacked.
Figure 7A:
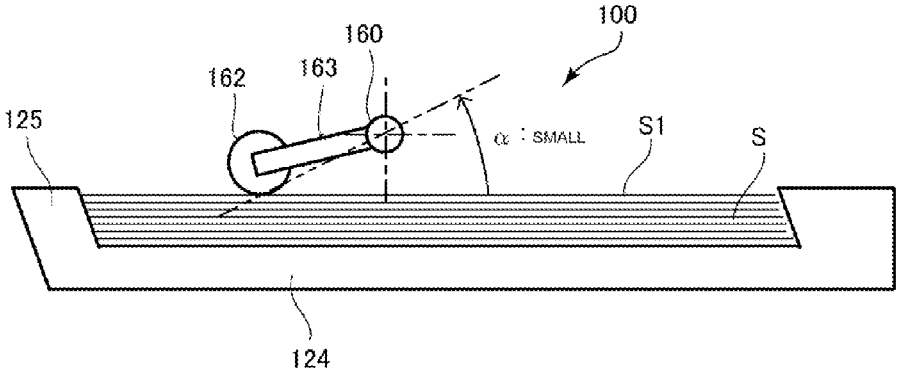
FIG. 7A PRIOR ART
FIG. 7A is a sectional view illustrating a sheet feed device according to the related art, when sheets are fully stacked.
Figure 7B:
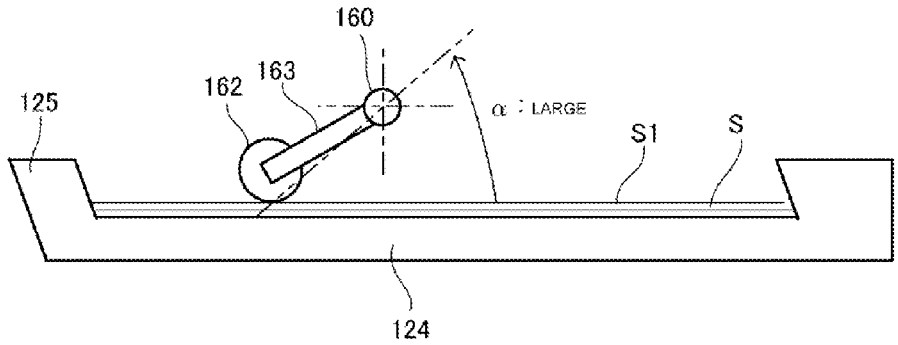
FIG. 7B PRIOR ART
FIG. 7B is a sectional view illustrating the sheet feed device according to the related art, when a few of sheets are stacked.

Next, a sheet feeding process performed by the sheet feed device 2 according to this embodiment will be described with reference to FIGS. 6A to 6D in addition to FIGS. 5A and 5B. FIG. 6A is a sectional view illustrating the rotation stacking portion 26 in the flat state, when sheets are fully stacked. FIG. 6B is a sectional view illustrating the rotation stacking portion 26 in the flat state, when a few of sheets are stacked. FIG. 6C is a sectional view illustrating the rotation stacking portion 26 in a rotation state, when the sheet are fully stacked. FIG. 6D is a sectional view illustrating the rotation stacking portion 26 in the rotation state, when a few of sheets are stacked.

When the sheet feeding process of feeding a sheet by the sheet feed device 2 starts together with the above-described process of forming the toner image, the driving motor (not illustrated) is driven. Then, the driving force of the driving motor is transmitted to the roller arm driving gear 74 through the driving input gear 71, the first intermediate gear 72, and the second intermediate gear 73 to rotate the roller arm driving gear 74.

When the roller arm driving gear 74 is rotated, the lifting and lowering cam 75 adhered to the roller arm driving gear 74 is rotated, the engagement protrusion portion 67 of the roller arm 63 engages with the rotated lifting and lowering cam 75, and thus the roller arm 63 is rotated (vertically pivoted). For example, as illustrated in FIG. 5A, when the lifting and lowering cam 75 engages with the engagement protrusion portion 67, the roller arm 63 is held upward, and thus the sheet feed roller 62 is held upward. On the other hand, as illustrated in FIG. 5B, when the engagement of the lifting and lowering cam 75 with the engagement protrusion portion 67 is released, the roller arm 63 falls due to the own weight of the sheet feed roller 62 or the like and the sheet feed roller 62 comes into contact with the surface of the topmost sheet S1 of the sheets S. In this embodiment, the sheet feed roller 62 is configured to fall due to the own weight of the sheet feed roller 62 or the like. However, for example, the sheet feed roller 62 may be configured to fall due to an urging force of an urging spring in addition to the own weight of the sheet feed roller 62 or the like.

When the roller arm driving gear 74 is rotated, the first driving gear G1 engaging with the roller arm driving gear 74 is rotated. Further, when the first driving gear G1 is rotated, the pivot shaft 60 is rotated. When the pivot shaft 60 is rotated, the second driving gear G2 adhered to the other end of the pivot shaft 60 is rotated, and thus the sheet feed roller 62 is rotated through the gear line 61 (the first gear 64 and the second gear 65) engaging with the second driving gear G2.

When the sheet feed roller 62 coming into contact with the surface of the topmost sheet S1 of the sheets S is rotated, the topmost sheet S1 is fed by the sheet feed roller 62. Continuously, when the roller arm driving gear 74 is rotated, the lifting and lowering cam 75 engages with the engagement protrusion portion 67 of the roller arm 63 again, the roller arm 63 is thus lifted and the sheet feed roller 62 is thus separated from the sheet S. Further, the feeding of the topmost sheet S1 is performed by a predetermined amount by rotating the sheet feed roller 62 for a predetermined amount, while the engagement of the engagement protrusion portion 67 with the lifting and lowering cam 75 is released, that is, while the roller arm 63 is lowered and the sheet feed roller 62 comes into contact with the topmost sheet S1.

When the topmost sheet S1 is fed by the sheet feed roller 62, only the topmost sheet S1 is loosened from the sheet S, the topmost sheet S1 is separated from the sheet S to be fed by cooperation of the separation inclination surface 25*a* of the separation wall 25 erected on the downstream side and the sheet feed roller 62. Thereafter, the topmost sheet S1 is conveyed to the transfer nip N by the pair of intermediate conveyance rollers on the downstream side, a toner image is formed in the transfer nip N, the toner image is fixed, and the topmost sheet S1 is stacked in the discharge tray 52.

In this embodiment, as illustrated in FIGS. 6A to 6D, when a sheet with a basis weight equal to or greater than 60 ($g/m^2$) is fed, the sheet can be separated and fed in spite of the fact that the sheets S are fully stacked (see FIG. 6A) or a few of sheets S are stacked (see FIG. 6B) in the sheet stacking portion 21.

This is because a necessary abutting pressure (feeding pressure) is not so small for a sheet with a basis weight equal to or greater than 60 ($g/m^2$), and thus the double conveyance does not occur even when a few of sheets are stacked in the sheet stacking portion 21. In this embodiment, a feeding pressure necessary for a sheet with a basis weight equal to or greater than 60 ($g/m^2$) is ensured, even when the sheets are fully stacked in the sheet stacking portion 21.

On the other hand, when a thin sheet with a basis weight less than 60 ($g/m^2$) is fed, the double conveyance easily occurs due to the fact that a necessary abutting pressure is small. Since the reason why the double conveyance occurs when a thin sheet is fed has been described above, the description thereof will not be repeated.

In this embodiment, when a thin sheet is fed, a user rotates the rotation stacking portion 26 up to a rotation position, and then extracts the inclination stay 28 to hold the rotation stacking portion 26 at the rotation position. Then, the user stacks a thin sheet in the rotation stacking portion 26 located at the rotation position. Further, the user may stack a thin sheet, and then may rotate and hold the rotation stacking portion 26. Thus, as illustrated in FIG. 6C, even when the number of stacked sheets is large, a feed failure does not occur due to the fact that the feeding pressure necessary for the thin sheet is low and the feeding pressure necessary to fed the thin sheet is ensured. As illustrated in FIG. 6D, even when the number of sheets is small, the double conveyance is prevented.

Since the rotation shaft 27 rotating the rotation stacking portion 26 is installed on the downstream side of the contact point A between the sheet feed roller 62 and the topmost sheet S1, the angle α can be decreased by rotating the rotation stacking portion 26.

The embodiment has been described in which the rotation stacking portion 26 is located at the two positions, that is, the position at which the rotation stacking portion 26 is substantially horizontal and the position at which the rotation stacking portion 26 is rotated, but the invention is not limited thereto. The rotation stacking portion 26 may be configured such that the rotation stacking portion 26 is located at three or more positions. Thus, since the number of positions of the rotation stacking portion 26 which can be set by the user can be increased, separation and sheet feeding corresponding to the number of stacked sheets can be achieved.

The sheet feed device 2 according to this embodiment can improve the capability of feeding a thin sheet or the separation capability without new addition of an elastic member such as a rubber or a high-priced member such as a specially processed separating member to, for example, the sheet feed roller, the roller arm, or the separating portion. Thus, the separation capability can be improved, while suppressing an increase in the size of the device or an increase in cost.

The sheet stacking portion 21 is configured to be inclined from the upstream side to the downstream side. Therefore, even in a case of a thin sheet, the front end (the downstream side of a sheet) of a sheet can be set in the sheet stacking portion 21 without use of a regulating member that regulates the upstream side (rear end) of the sheet.

When a sheet with a basis weight equal to or greater than 60 ($g/m^2$) is fed, a feed force of the sheet feed roller 62 can be increased by returning the rotation stacking portion 26 in the rotation state to the flat state. Accordingly, it is possible to prevent the capability of feeding a sheet with a basis weight equal to or greater than 60 ($g/m^2$) from deteriorating.

The embodiment of the invention has been described, but the invention is not limited to the above-described embodiment. The advantages described in the embodiment of the invention are merely recited advantages exemplified in the invention. The advantages of the invention are not limited to the advantages described in the embodiment of the invention.

In the above-described embodiment, the inclination stay 28 is configured such that the inclination stay 28 is drawn from the bottom surface of the rotation stacking portion 26 and engages with an engagement portion 29 formed in the fixed stacking portion 24 to hold the rotation stacking portion 26, but the invention is not limited thereto. For example, the inclination stay 28 may be configured such that the inclination stay 28 protrudes in conjunction with the rotation of the rotation stacking portion 26, a button operation, or the like and engages with the engagement portion 29. Further, for example, a retractable projection may be formed in the rotation stacking portion 26 and may engage with a hole portion formed in the fixed stacking portion 24 to be fixed. For example, a part of the rotation shaft 27 may be threaded and fastened at a threaded portion to stop the rotation of the rotation stacking portion 26. Further, the rotation stacking portion 26 may be configured to be held step by step at a plurality of rotation positions.

In the above-described embodiment, the sheet stacking portion is configured to include the fixed stacking portion 24 on the downstream side of the rotation stacking portion 26, but the invention is not limited thereto. As long as the feed capability does not deteriorate, the rotation shaft 27 of the rotation stacking portion 26 may be formed in the vicinity of the base end of the separation wall 25 and the fixed stacking portion 24 may not be provided.

In the above-described embodiment, the separating portion has the configuration in which an inclination surface separation type in which the separation inclination surface 25*a* of the separation wall 25 separates the topmost sheet S1 is used, but the invention is not limited thereto. For example, the separating portion may use another separation type in which a sheet is loosened using the rigidity (stiffness) of the sheet.

In the above-described embodiment, the sheet feed roller 62 is configured to be rotated using the pivot shaft 60 on the upstream side in the sheet feed direction as a fulcrum, but the invention is not limited thereto. The sheet feed roller 62 may be configured such that the sheet feed roller 62 is rotatable using the pivot shaft 60 on the downstream side in the sheet feed direction as a fulcrum. In this case, the larger the number of stacked sheets is, the larger the feeding pressure (abutting pressure) of the sheet feed roller 62 to a topmost sheet is. Accordingly, in this case, when a thick sheet with a large basis weight is used or the number of stacked sheets is small, the user rotates the rotation stacking portion 26 upward.

The configuration has been described above in which the operation of rotating the rotation stacking portion 26 is performed by a user, but the invention is not limited thereto. For example, a CPU may determine whether the rotation stacking portion 26 is rotated based on information or the like regarding the basis weight of a sheet input by the user and the rotation stacking portion 26 may be configured to be driven and rotated by a motor or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-026411, filed Feb. 9, 2012, which is hereby incorporated by reference herein in its entirety.

What is claimed is:

1. A sheet feed device which feeds a sheet, comprising:

a sheet stacking portion that includes a rotation stacking portion which is rotatable;

a sheet feed roller that feeds a sheet stacked on the sheet stacking portion;

a separating portion that separates the sheet fed by the sheet feed roller, wherein the rotation stacking portion is configured to be rotatable about a rotation fulcrum located on a downstream side in a sheet feed direction of a contact point of the sheet feed roller to the sheet stacked on the stacking portion, and wherein the rotation stacking portion is configured to be rotatable between a first position and a second position, the second position being a position at which the rotation stacking portion has been rotated about the rotation fulcrum so that an upstream side in the sheet feed direction is higher than an upstream side in the sheet feed direction when the rotation stacking portion is in the first position; and a hold member configured to hold the rotation stacking portion at the second position, wherein the sheet feed roller is configured to feed the sheet whether the rotation stacking portion is at the first position or at the second position, and wherein the sheet feed roller is above the rotation stacking portion.

2. The sheet feed device according to claim 1, wherein the sheet stacking portion includes a fixed stacking portion which is installed on the downstream side of the rotation stacking portion.

3. The sheet feed device according to claim 1, further comprising:

a roller holding portion that holds the sheet feed roller and is rotatable about a rotation fulcrum located on an upstream side in the sheet feed direction of the contact point of the sheet feed roller to the sheet stacked on the stacking portion.

4. The sheet feed device according to claim 1, wherein the first position of the rotation stacking portion is a position at which the rotation stacking portion is substantially horizontal and the second position of the rotation stacking portion is a position at which the rotation stacking portion is rotated so that the upstream side of the rotation stacking portion in the sheet feed direction is higher than a downstream side of the rotation stacking portion in the sheet feed direction.

5. The sheet feed device according to claim 3, wherein an angle formed between a line binding the rotation fulcrum of the roller holding portion and the contact point of the sheet feed roller to the sheet stacking portion and a line along a surface of a topmost sheet stacked in the sheet stacking portion is smaller at the position at which the rotation stacking portion is inclined than at a position at which the rotation stacking portion is substantially horizontal.

6. The sheet feed device according to claim 1, wherein the separating portion is installed on the downstream side of the sheet stacking portion in the sheet feed direction and includes a separation wall inclined on the downstream side in the sheet feed direction.

7. The sheet feed device according to claim 2, wherein the rotation fulcrum of the rotation stacking portion is formed in the fixed stacking portion.

8. An image forming apparatus comprising:

the sheet feed device according to claim 1; and an image forming portion that forms an image on a sheet fed by the sheet feed roller.

9. The sheet feeding device according to claim 1, wherein a feeding pressure of the sheet feed roller to the sheet stacked on the sheet stacking portion at a time when the rotation stacking portion is at the first position is larger than the feeding pressure of the sheet feed roller to the sheet stacked on the sheet stacking portion at a time when the rotation stacking portion is at the second position.

* * * * *